US008692169B2

(12) United States Patent
Lin

(10) Patent No.: US 8,692,169 B2
(45) Date of Patent: Apr. 8, 2014

(54) ELECTRICAL APPARATUS HAVING ACTIVE HEAT-DISSIPATING ELEMENT AND AIR CIRCULATING SYSTEM HAVING SUCH ELECTRICAL APPARATUS

(75) Inventor: I-Shen Lin, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 356 days.

(21) Appl. No.: 12/715,546

(22) Filed: Mar. 2, 2010

(65) Prior Publication Data

US 2010/0219179 A1 Sep. 2, 2010

(30) Foreign Application Priority Data

Mar. 2, 2009 (TW) ..... 98106754 A

(51) Int. Cl.
*H05B 6/12* (2006.01)

(52) U.S. Cl.
USPC ..... 219/623; 219/622; 219/677; 219/452.11; 126/21 A; 237/47

(58) Field of Classification Search
USPC ..... 219/623, 620, 542.11, 452.11, 677, 219/622; 126/1 R, 21 A, 21 R; 237/21, 47
See application file for complete search history.

(56) References Cited

U.S. PATENT DOCUMENTS

2004/0262303 A1* 12/2004 Kang ..... 219/757
2006/0049177 A1* 3/2006 Park et al. ..... 219/622
2006/0163244 A1* 7/2006 Valero et al. ..... 219/621
2006/0237425 A1* 10/2006 Kim et al. ..... 219/400
2007/0278215 A1* 12/2007 Schilling et al. ..... 219/622
2008/0017630 A1* 1/2008 Fandos et al. ..... 219/481
2008/0172875 A1* 7/2008 Sakai et al. ..... 29/888.02
2008/0185376 A1* 8/2008 Gagas et al. ..... 219/623

FOREIGN PATENT DOCUMENTS

| | | |
|---|---|---|
| CN | 2847094 | 12/2006 |
| CN | 201103941 | 8/2008 |
| CN | 201149299 | 11/2008 |
| CN | 101354149 | 1/2009 |
| CN | 201191023 | 2/2009 |

* cited by examiner

*Primary Examiner* — Fernando L Toledo
*Assistant Examiner* — Peter Bradford
(74) *Attorney, Agent, or Firm* — Kirton McConkie; Evan R. Witt

(57) ABSTRACT

An electrical apparatus includes a casing, a circuit board, a top cover and an active heat-dissipating element. The casing includes a first entrance, a first receptacle, a first sidewall, and a first bottom surface. An air inlet hole is formed in the first bottom surface. A concave region is defined at a junction between the first sidewall and the first bottom surface. An air outlet hole is formed in the concave region. The circuit board is disposed within the first receptacle and has at least one electronic component mounted thereon. The top cover shelters the first entrance. The active heat-dissipating element is disposed within the first receptacle and arranged over the air inlet hole. Ambient air is inhaled into the first receptacle by the active heat-dissipating element and exhausted out of the casing through the air outlet hole, thereby removing heat generated from the electronic component.

18 Claims, 8 Drawing Sheets

ELECTRICAL APPARATUS HAVING ACTIVE HEAT-DISSIPATING ELEMENT AND AIR CIRCULATING SYSTEM HAVING SUCH ELECTRICAL APPARATUS

FIELD OF THE INVENTION

The present invention relates to an electrical apparatus, and more particularly to an electrical apparatus having enhanced heat-dissipating efficiency. The present invention also relates to an air circulating system having such an electrical apparatus.

BACKGROUND OF THE INVENTION

Induction cooking stoves are widely used to cook food. Generally, the induction cooking stoves are placed on desk planes during operations. For increasing space utilization and demonstrating the harmonic aesthetic effect of the whole kitchen utensils, the induction cooking stoves are usually embedded within a cabinet. In comparison with the conventional kitchen utensil with a fire stove, the kitchen utensil with an embedded induction cooking stove is relatively neat, clean and easily managed. As a consequence, the embedded induction cooking stove is gaining popularity. Since the embedded induction cooking stove is enclosed by side plates of the cabinet, the heat-dissipating mechanism is very critical when designing an embedded induction cooking stove.

FIG. 1 is a schematic exploded view illustrating a heat-dissipating mechanism of an embedded induction cooking stove according to the prior art. Within the casing 10, the induction cooking stove 1 comprises a supporting part 11, a control unit 12, an air inlet module 13, and an air outlet part 14. The supporting part 11 is disposed on the casing 10. The control unit 12 is arranged at the front end of the supporting part 11. The air outlet part 14 is arranged at the rear end of the supporting part 11. The air outlet part 14 and the air inlet module 13 cooperate with each other to dissipate heat. The casing has a receptacle for accommodating a circuit board (not shown) and a heat sink (not shown). Several air inlet holes 101 are disposed in the bottom surface and the front end of the casing 10. In addition, several perforations 102 are formed in the front surface and the rear surface of the casing 10. By penetrating fastening elements (not shown) through the perforations 102, the induction cooking stove 1 could be fixed to a cabinet 2 (see FIG. 2). The air inlet module 13 includes a fan 131 and a fan stand 13 and the air inlet holes 101. The fan 131 is fixed on the fan stand 132 and arranged over the air inlet holes 101. During operation of the fan 131, the ambient air is inhaled into the internal portion of the induction cooking stove 1 through the air inlet holes 101 in order to remove heat generated from the electronic components (not shown) of the induction cooking stove 1.

The supporting part 11 includes a supporting plate 111 and an outer frame 112. The supporting plate 111 is usually made of ceramic material or heat-resistant hard material. The outer frame 112 is arranged at the periphery of the supporting plate 111 and attached onto the casing 10. The control unit 12 is usually made of plastic material. The control unit 12 has an operating panel 121 with multiple operating parts 122. When one of the operating parts 122 is triggered, the induction cooking stove 1 executes a corresponding function. The air outlet part 14 is a raised hollow block having an elongated air outlet hole 141. During operation of the fan 131, the ambient air is inhaled into the casing 10 through the air inlet holes 101, then transferred through the heat sink and electronic components (not shown), and finally exhausted out of the casing through the air outlet part 14 in order to remove the heat generated from the induction cooking stove 1.

FIG. 2 is a schematic cross-sectional view illustrating the conventional embedded induction cooking stove mounted in a cabinet. As shown in FIG. 2, the induction cooking stove 1 is embedded in the cabinet 2. During operation of the induction cooking stove 1, the fan 131 is activated to inhale ambient air. The ambient air is introduced into the cabinet 2 through the entrance 21 at the bottom portion or the entrance 22 at the front side of the cabinet 2, then transferred toward the induction cooking stove 1 along the inner wall of the cabinet 2, and then introduced into the internal portion of the induction cooking stove 1 through the air inlet holes 101. A portion of the heat generated from the induction cooking stove 1 is removed by the inhaled air, and the hot air is exhausted out of the casing through the air outlet hole 141. As shown in FIG. 2, the air circulates in the direction A. Since the backside of the cabinet 2 is usually in contact with or close to a wall 3. The hot air exhausted out of the induction cooking stove 1 is obstructed by the wall 3. Under this circumstance, the hot air possibly returns back or accumulates at the region neighboring the air outlet hole 141 and the heat-dissipating efficiency is deteriorated.

There is a need of providing an improved electrical apparatus so as to obviate the drawbacks encountered from the prior art.

SUMMARY OF THE INVENTION

An object of the present invention provides an electrical apparatus having enhanced heat-dissipating efficiency.

Another object of the present invention provides an air circulating system having such an electrical apparatus.

In accordance with an aspect of the present invention, there is provided an electrical apparatus. The electrical apparatus includes a casing, a circuit board, a top cover and an active heat-dissipating element. The casing includes a first entrance, a first receptacle communicating with the first entrance, a first sidewall, and a first bottom surface. At least one air inlet hole is formed in the first bottom surface. A concave region is defined at a junction between the first sidewall and the first bottom surface. At least one air outlet hole is formed in the concave region. The circuit board is disposed within the first receptacle and has at least one electronic component mounted thereon. The top cover shelters the first entrance. The active heat-dissipating element is disposed within the first receptacle and arranged over the air inlet hole. Ambient air is inhaled into the first receptacle by the active heat-dissipating element and exhausted out of the casing through the air outlet hole, thereby removing heat generated from the electronic component.

In accordance with another aspect of the present invention, there is provided an air circulating system. The air circulating system includes the electrical apparatus of the present invention and a cabinet. The cabinet has a third sidewall and a recess portion. An outlet channel and a second entrance are formed in the third sidewall. The outlet channel communicates with the recess portion. The electrical apparatus is accommodated within the recess portion of the cabinet. Ambient air inhaled by the active heat-dissipating element is introduced into the cabinet through the second entrance, then transferred through the first receptacle, then exhausted out of the electrical apparatus through the air outlet hole, and finally exhausted out of the cabinet through the outlet channel, thereby removing heat generated from the electrical apparatus.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
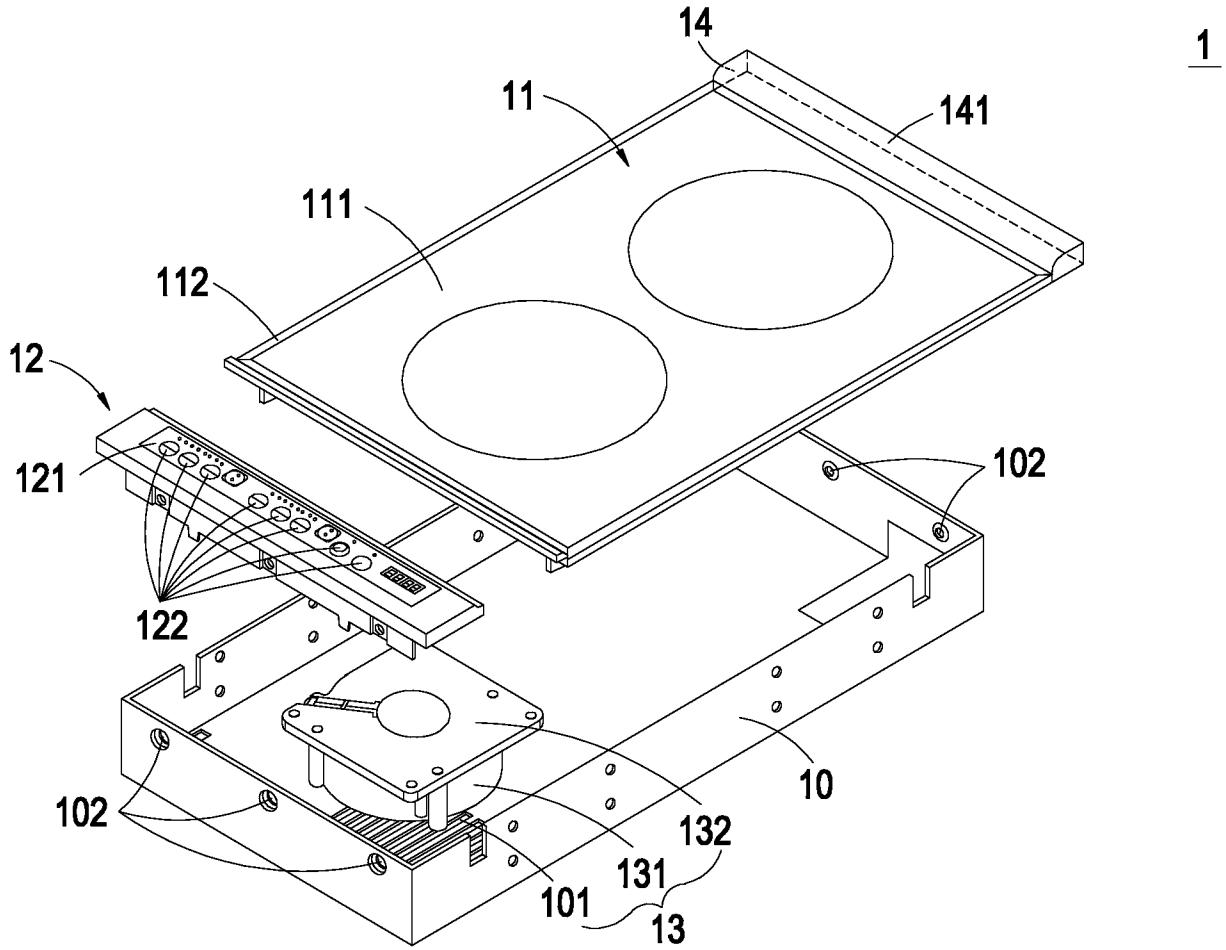
FIG. 1 PRIOR ART
FIG. 1 is a schematic exploded view illustrating a heat-dissipating mechanism of an embedded induction cooking stove according to the prior art.
Figure 2:
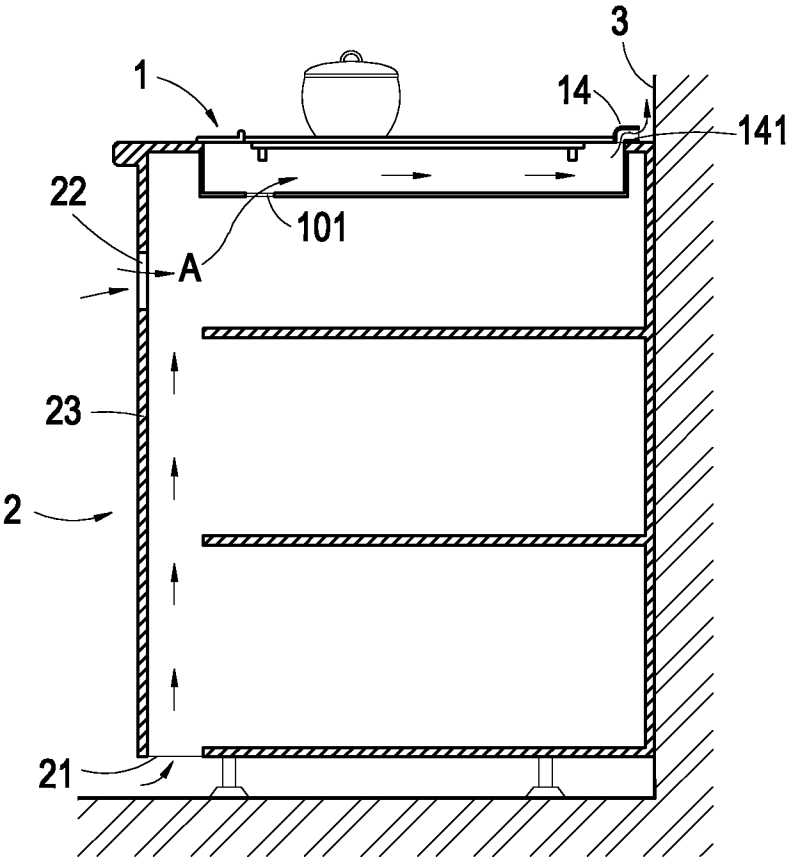
FIG. 2 PRIOR ART
FIG. 2 is a schematic cross-sectional view illustrating the conventional embedded induction cooking stove mounted in a cabinet.
Figure 3:
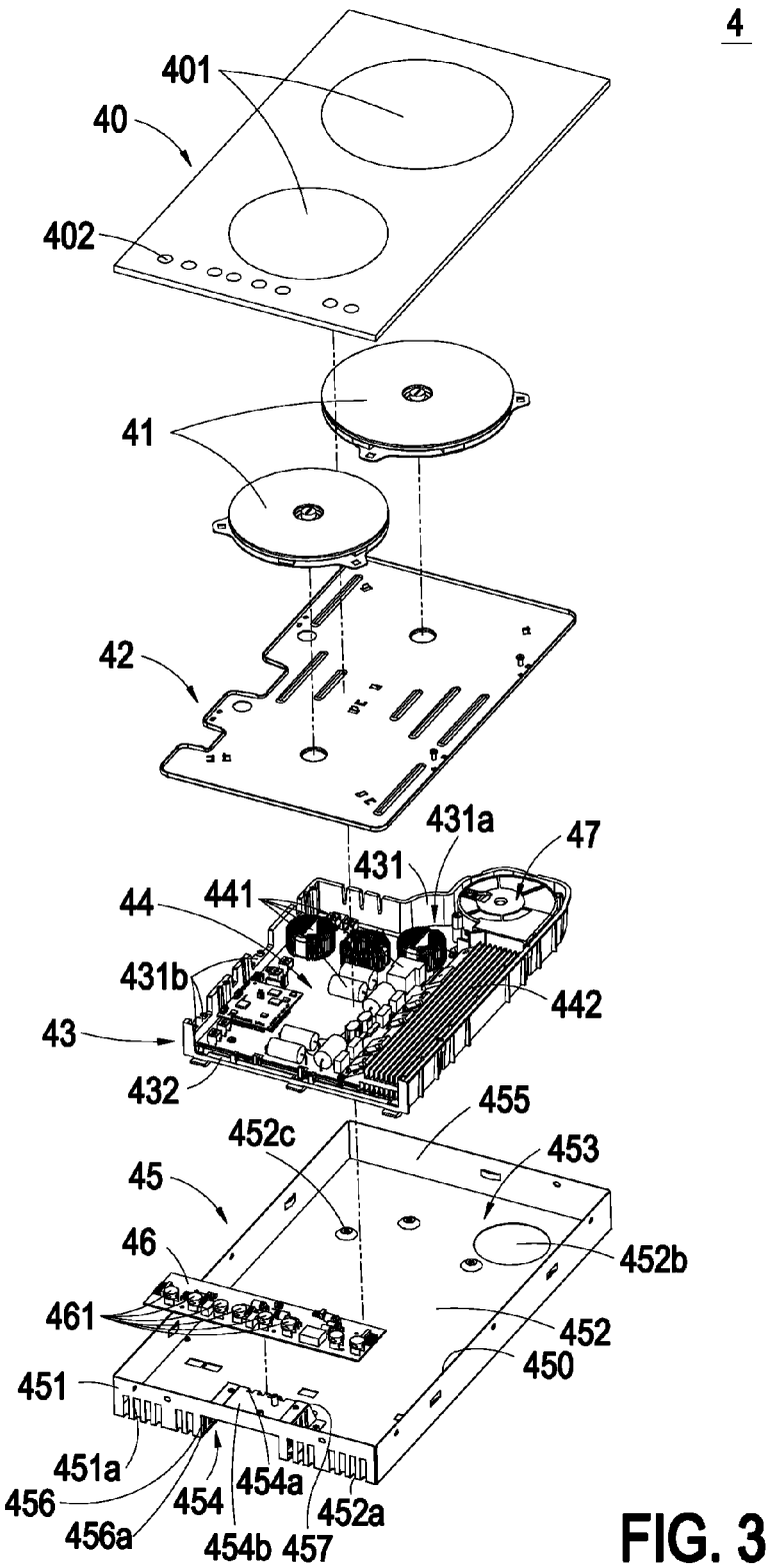
FIG. 3 is a schematic exploded view illustrating an electrical apparatus according to an embodiment of the present invention.

FIG. 3 is a schematic exploded view illustrating an electrical apparatus according to an embodiment of the present invention. An example of the electrical apparatus 4 includes but is not limited to an induction cooking stove. As shown in FIG. 3, the induction cooking stove 4 comprises a top cover 40, at least a disk-like induction coil 41, a supporting plate 42, a circuit plate 44, a receiving frame body 43 and a casing 45. The casing 45 is substantially rectangular in shape and has a receptacle. It is preferred that the casing 45 is an integral component. In an embodiment, the casing 45 is made of metallic material such as iron. The casing 45 has a first entrance 450, a first sidewall 451, a second sidewall 455, a first bottom surface 452 and a first receptacle 453. The first receptacle 453 communicates with the first entrance 450. The first sidewall 451 and the second sidewall 455 are opposed to each other. The first sidewall 451 and the second sidewall 455 are substantially perpendicular to the first bottom surface 452. In addition, a concave region 454 is defined at the junction between the central portion of the first sidewall 451 and the first bottom surface 452. The concave region 454 has a first surface 454*b*, a second surface 457, and two lateral surface 456, the two lateral surface 456 is correspondingly disposed with each other, the first surface 454*b* is adjacent to the second surface 457 and the two lateral surface 456, and an angle Θ is defined between the second surface 457 and the lateral surface 456 of the concave region 454. At least one air outlet hole 454*a* is formed in the second surface 457 of the concave region 454, and the at least one air outlet hole 454*a* of the second surface 457 is at a distance from the first sidewall 451. Optionally, several air outlet holes 451*a* and 452*a* are formed in the two sides adjacent to the concave region 454 of the first sidewall 451 and the junction between the first sidewall 451 and the first bottom surface 452, and at least one air outlet hole 456*a* is formed in the lateral surface 456 of the concave region 454. At least one air inlet hole 452*b* and multiple perforations 452*c* are formed in the first bottom surface 452 and in the vicinity of the second sidewall 455. In addition, the circuit plate 44 and an active heat-dissipating element 47 are fixed on the receiving frame body 43. An example of the active heat-dissipating element 47 includes but is not limited to a fan. By penetrating fastening elements (not shown) through the perforations 452*c*, the receiving frame body 43 is fixed in the first receptacle 453 of the casing 45.

Figure 4:
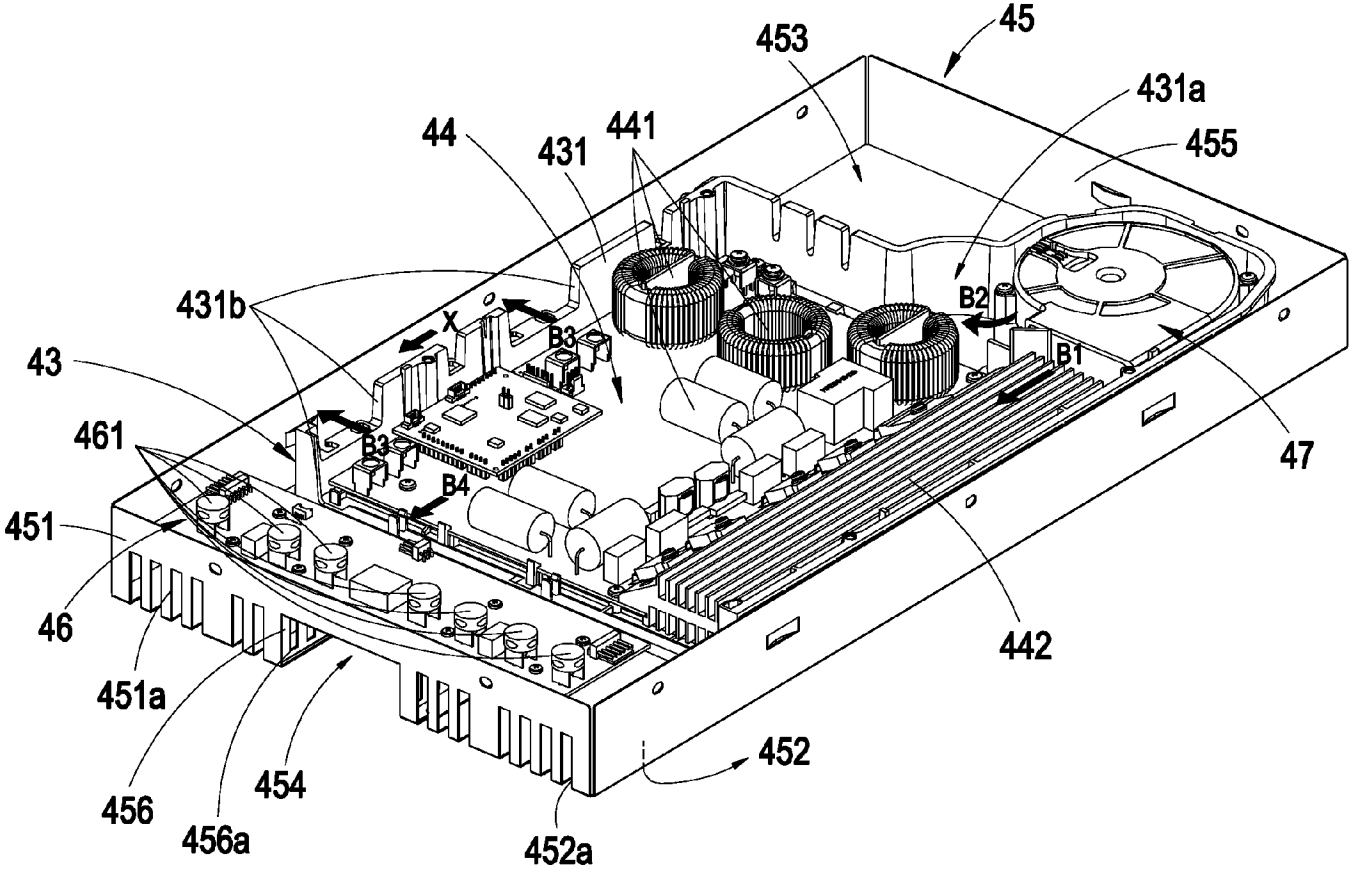
FIG. 4 is a schematic assembled view illustrating the combination of the receiving frame body and the casing of the electrical apparatus shown in FIG. 3.

FIG. 4 is a schematic assembled view illustrating the combination of the receiving frame body and the casing of the electrical apparatus shown in FIG. 3. Please refer to FIGS. 3 and 4. The induction cooking stove 4 further comprises a control unit 46. The control unit 46 is disposed on the first surface 454*b* of the concave region 454 of the casing 45. The control unit 46 includes multiple operating parts 461 corresponding to the operating keys 402 on the top cover 40. When one of the operating parts 461 is depressed, a corresponding operating key 402 is triggered such that the induction cooking stove 4 executes a corresponding function. The receiving frame body 43 is arranged between the circuit plate 44 and the casing 45. The receiving frame body 43 has a side frame 431 and a second bottom surface 432. A portion of the side frame 431 has a curvy surface defining an airflow guiding channel 431*a*. The airflow guiding channel 431*a* can facilitate guiding the airflow in the direction B2. Optionally, the side frame 431 has one or more notches 431*b* for exhausting the airflow out of the receiving frame body 43 in the direction B3 in order to increase the airflow channels.

The circuit board 44 and the fan 47 are disposed on the receiving frame body 43. The fan 47 is arranged over the air inlet hole 452*b* of the casing 45 for inhaling ambient air into the internal portion of the receiving frame body 43 through the air inlet hole 452*b*. Several electronic components 441 and one or more heat sinks 442 are mounted on the circuit board 44. The heat sinks 442 are disposed in the vicinity of the fan 47 for guiding the air inhaled by the fan 47 to flow in the direction B1.

Please refer to FIG. 3 again. The supporting plate 42 is disposed over the circuit board 44. The supporting plate 42 is made of a conductive and non-magnetic metallic material. In an embodiment, the supporting plate 42 is made of aluminum. The induction coil 41 is supported on the supporting plate 42 and electrically connected with the circuit board 44. When a current flows through the induction coil 41, electromagnetic induction is performed to produce eddy current, thereby heating an object 6 (e.g. a pan) that is placed on the induction cooking stove 4 (see FIG. 6B). The number of the induction coils 41 may be altered according to the practical requirements. For example, one, two or four induction coils 41 are feasible.

Please refer to FIG. 3 again. The top cover 40 is disposed over the induction coils 41. The top cover 40 is made of glass or ceramic material. The top cover 40 has cooking regions 401 aligned with the induction coils 41. The cooking regions 401 are slabs with a color different from the remaindering portion of the top cover 40 in order to indicate the regions for placing the pan 6 thereon. When the pan 6 is placed on the cooking region 401, the electromagnetic induction generated from the coil 41 will heat the pan 6.

Figure 5:
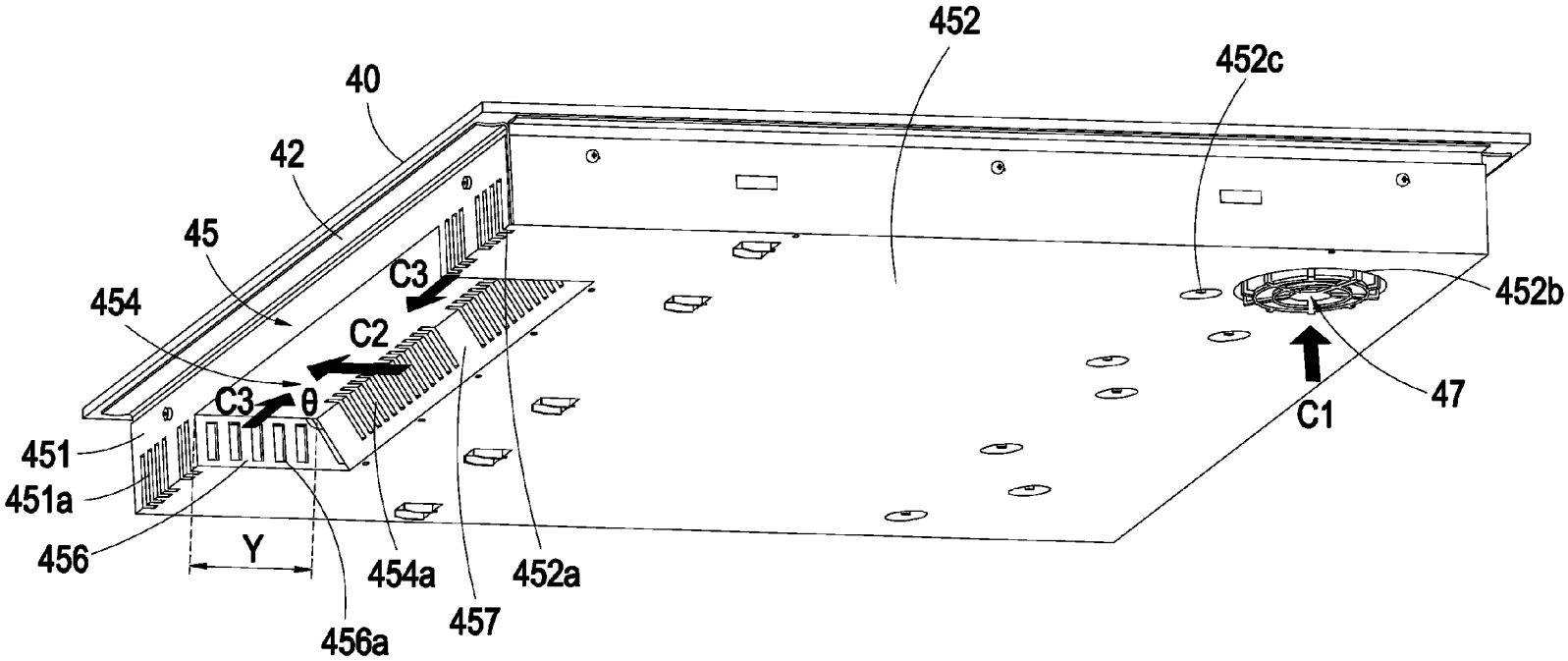
FIG. 5 is a schematic backside view illustrating the combination of the receiving frame body and the casing of the electrical apparatus shown in FIG. 3.

FIG. 5 is a schematic backside view illustrating the combination of the receiving frame body and the casing of the electrical apparatus shown in FIG. 3. Please refer to FIGS. 4 and 5. After the circuit board 44 and the fan 47 are accommodated within the receiving frame body 43 and the receiving frame body 43 is accommodated within the casing 45, the ambient air is inhaled into the internal portion of the casing 45 in the direction C1 through the air inlet hole 452*b* (see FIG. 5) and then flows to the electronic components 441 and the heat sink 442 in the directions B1 and B2 (see FIG. 4) in order to remove a portion of heat generated by the electronic components 441. The hot air flowing through the circuit board 44 is exhausted out of the receiving frame body 43 in the direction B3 through the notches 431*b*. As such, an airflow channel X is defined between the receiving frame body 43 and the casing 45. The hot air flows along the airflow channel X and finally exhausted out of the casing 45 through the air outlet holes 451*a*, 452*a*, 456*a* and 454*a*. Meanwhile, the heat generated by the electronic components 441 is dissipated away the induction cooking stove 4. As shown in FIG. 5, the air outlet hole 454*a* of the second surface has a distance Y from the first sidewall 451. The heat generated by the electronic components 441 is exhausted out of the air outlet hole 454*a* of the second surface of the concave region 454 in the direction C2, in the mean while, the heat is also exhausted out from the air outlet hole 456*a* of the lateral surface 456 of the concave region in the direction C3 and the hot heat is quickly exhausted out of the induction cooking stove 4 through air outlet hole 454*a*, 456*a* in comparison with the hot air exhausted from the air outlet hole 451*a* of the first sidewall 451. In other words, the arrangement of the concave region 454 could enhance the heat-dissipating efficiency of the induction cooking stove 4.

Figure 6B:
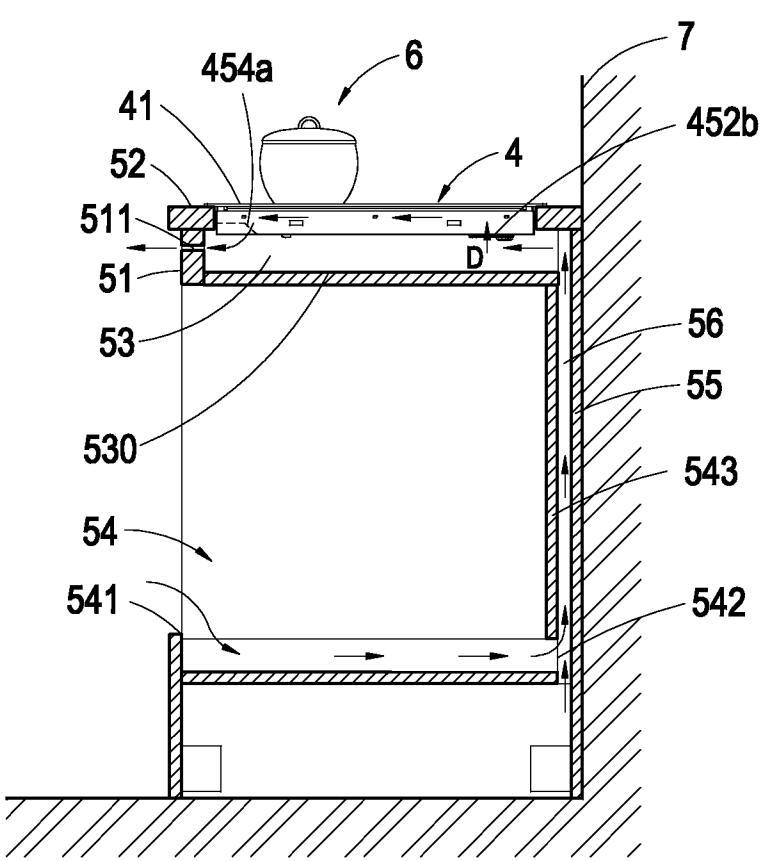
FIG. 6B is a schematic cross-sectional view illustrating an air circulating system of FIG. 6A.
Figure 6A:
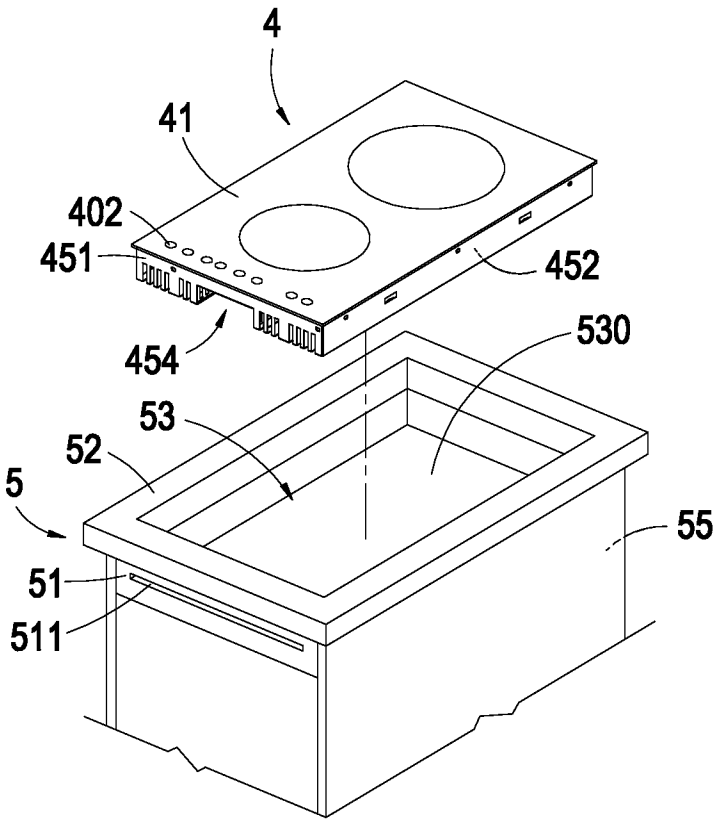
FIG. 6A is a schematic exploded view illustrating an air circulating system having the electrical apparatus according to another embodiment of the present invention.

FIG. 6A is a schematic exploded view illustrating an air circulating system having the electrical apparatus according to another embodiment of the present invention. FIG. 6B is a schematic cross-sectional view illustrating an air circulating system of FIG. 6A. The air circulating system comprises the induction cooking stove 4 and a cabinet 5. As shown in FIG. 6A, a recess portion 53 is formed in a top surface 52 of the cabinet 5. The induction cooking stove 4 is accommodated in the recess portion 53. Meanwhile, the first bottom surface 452 of the casing 45 faces a third bottom surface 530 of the recess portion 53, and the first sidewall 451 of the casing 45 faces a third sidewall 51 of the cabinet 5. For cooking food, the outer surface of the cabinet 5 could be in contact with or close to a wall 7, and the user is located at the side facing the first sidewall 451 of the casing 45. As shown in FIG. 6B, after the induction cooking stove 4 is accommodated in the recess portion 53, the top cover 41 of the induction cooking stove 4 could be supported on the top surface 52 of the cabinet 5 such that there is a gap between the induction cooking stove 4 and the third bottom surface 530 of the recess portion 53. Furthermore, an outlet channel 511 and a second receptacle 54 are formed in the third sidewall 51 of the cabinet 5. The outlet channel 511 is arranged at the half-upper portion of the third sidewall 51 and communicates with the recess portion 53. The second receptacle 54 has a second entrance 541 and a third entrance 542 that communicate with the surroundings. Through the second entrance 541 and the third entrance 542, other electrical apparatus (e.g. an oven) could be placed in the second receptacle 54. A groove 56 is defined between the outer wall 543 of the second receptacle 54 and the inner wall 55 of the cabinet 5. The third entrance 542 is arranged at the bottom of the second receptacle 54 and communicates with the groove 56. An end of the groove 56 communicates with the recess portion 53.

Please refer to FIGS. 4, 5 and 6B again. When the pan 6 is placed on the induction cooking stove 4 to be cooked, the ambient air is inhaled into the internal portion of the casing 45 of the induction cooking stove 4 through the air inlet hole 452*a*. The inhaled air circulates in the internal portion of the cabinet 5. As such, the inhaled air enters the second receptacle 54 of the cabinet 5 through the second entrance 541, and then flows through the groove 56 between the outer wall 543 of the second receptacle 54 and the inner wall 55 of the cabinet 5. The inhaled air is then introduced into the internal portion of the induction cooking stove 4 in order to dissipate away the heat of the induction cooking stove 4. The hot air is then exhausted out of the casing 45 through the air outlet holes 451*a*, 452*a* and 454*a* and then exhausted out of the cabinet 5 through the outlet channel 511. In other words, the inhaled air circulates in the internal portions of the cabinet 5 and the induction cooking stove 4, and exhausted out from the third sidewall 51 of the cabinet 51. Since the hot air exhausted out of the cabinet 5 is not obstructed by the wall 7, the exhausted hot air is quickly and smoothly radiated to the surroundings. As a consequence, the heat-dissipating efficiency is largely enhanced.

Figure 7A:
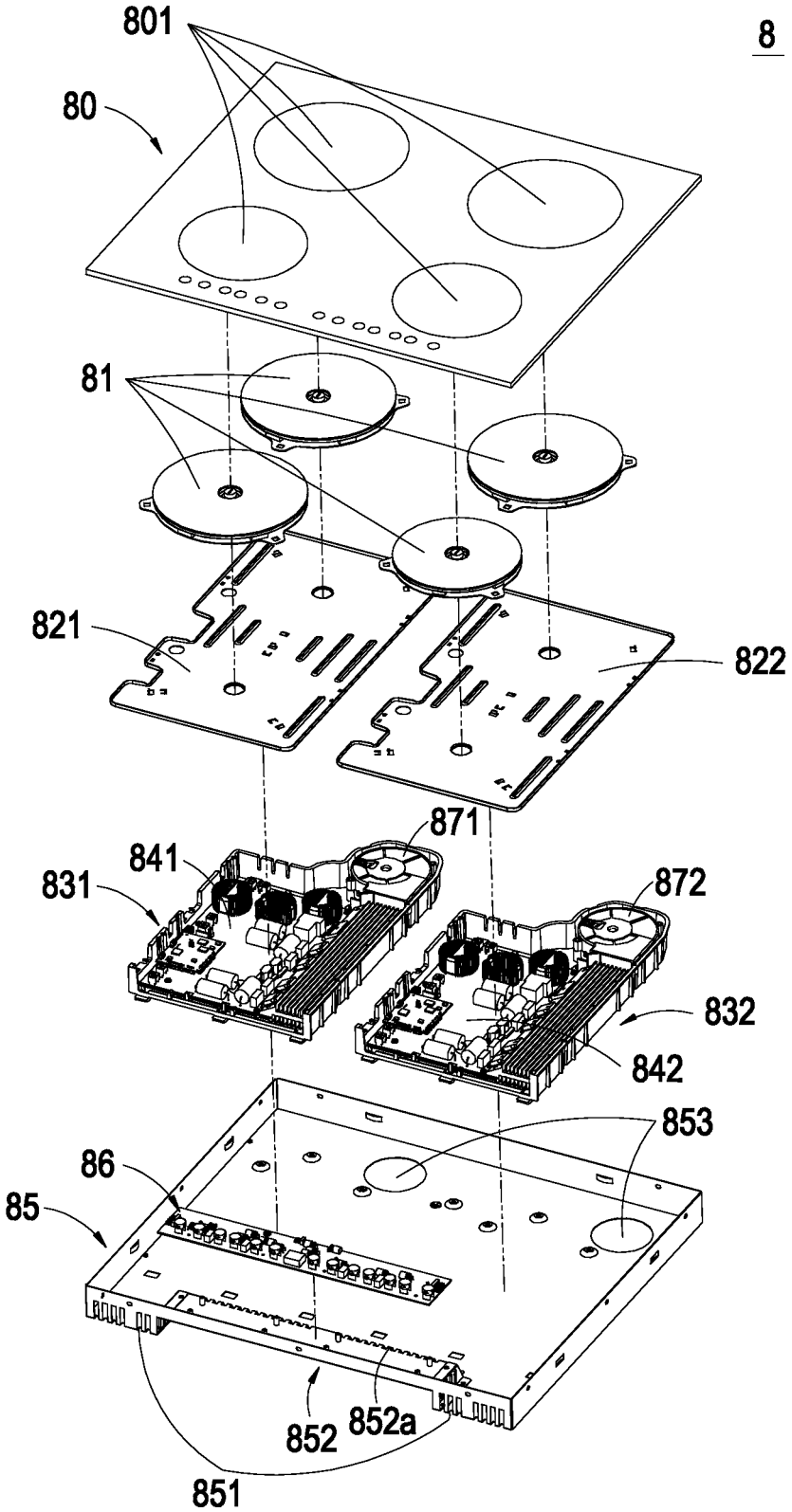
FIG. 7A is a schematic exploded view illustrating an electrical apparatus according to another embodiment of the present invention.

FIG. 7A is a schematic exploded view illustrating an electrical apparatus according to another embodiment of the present invention. An example of the electrical apparatus 8 includes but is not limited to an induction cooking stove. As shown in FIG. 7A, the induction cooking stove 8 comprises a top cover 80, several disk-like induction coils 81, two supporting plates 821, 822, two circuit plate 841, 842, two receiving frame bodies 831, 832, a control unit 86, and a casing 85. The configurations of the induction cooking stove 8 are similar to those illustrated in the above embodiments, and are not redundantly described herein. In this embodiment, the top cover 80 of the induction cooking stove 8 has four cooking regions 801 aligned with the induction coils 81. In addition, these two receiving frame bodies 831, 832 are accommodated within the casing 85. The circuit plate 841, 842 and two fans 871, 872 are accommodated within the receiving frame bodies 831, 832, respectively. The supporting plates 821, 822 are disposed over the circuit plate 841, 842, respectively. Two induction coils 81 are supported on the supporting plates 821, and the other two induction coils 81 are supported on the supporting plates 822.

Figure 7B:
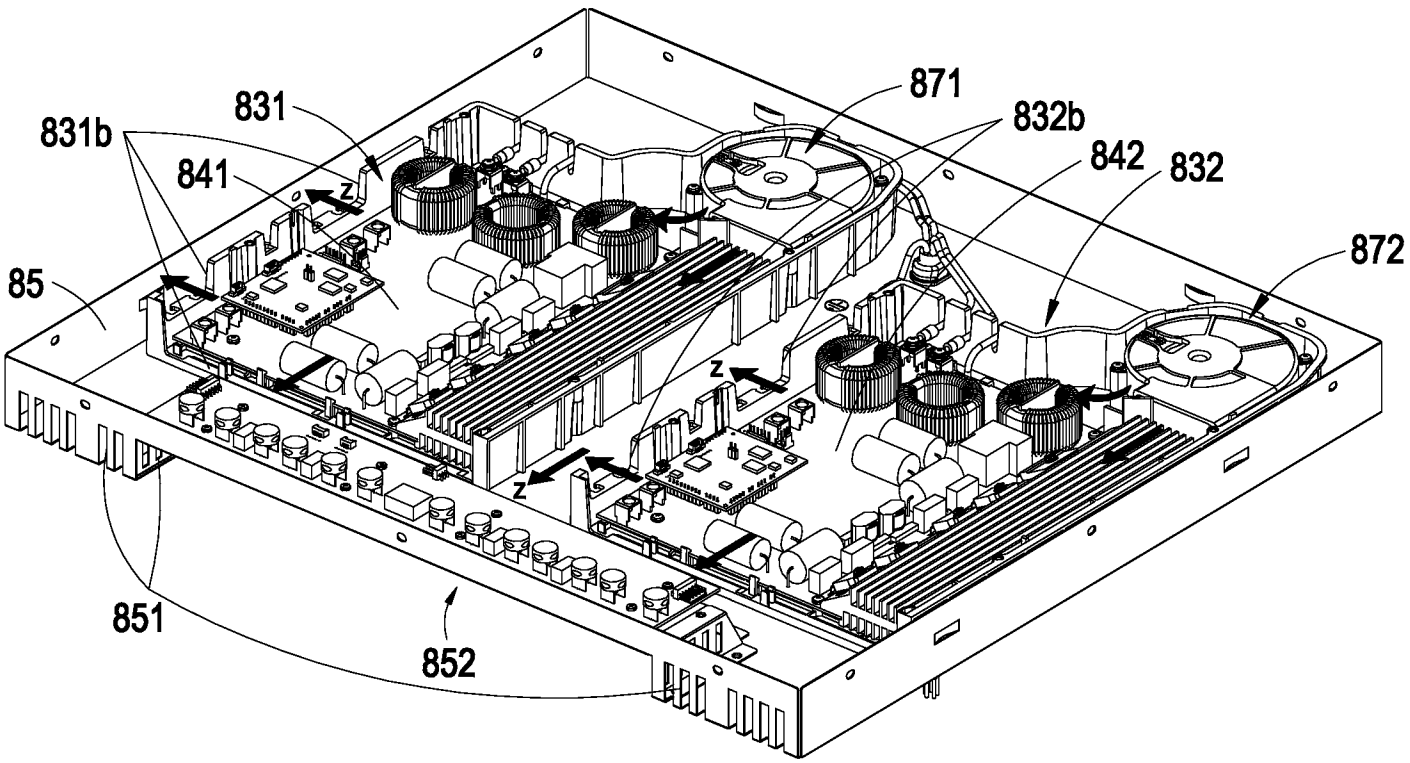
FIG. 7B is a schematic assembled view illustrating the combination of the receiving frame body and the casing of the electrical apparatus shown in FIG. 7A.

FIG. 7B is a schematic assembled view illustrating the combination of the receiving frame body and the casing of the electrical apparatus shown in FIG. 7A. When the fans 871 and 872 are activated, the ambient air is inhaled into the internal portions of the receiving frame bodies 831 and 832 through the air inlet hole 853 (see FIG. 7A). Similarly, the inhaled air flows to the electronic components and the heat sink in order to remove a portion of heat generated by the electronic components. The hot air is exhausted out of the receiving frame bodies 831 and 832 through the notches 831*b* and 832*b*. As such, several airflow channels Z are defined between the receiving frame bodies 831, 832 and the casing 45. The hot air flows along the airflow channels Z and finally exhausted out of the casing 45 through the air outlet holes 851*a* and 852*a*. In a case that the heat generated by the electronic components is exhausted out of the air outlet hole 852*a* of the concave region 852, the hot heat is quickly exhausted out of the induction cooking stove 8. In other words, the arrangement of the concave region 852 could enhance the heat-dissipating efficiency of the induction cooking stove 8.

From the above description, the electrical apparatus of the present invention includes a casing, a circuit board, a top cover and an active heat-dissipating element. The casing has an air inlet hole, an air outlet hole and a concave region. During operation of the active heat-dissipating element, the ambient air is inhaled into the internal portion of the casing to remove heat accumulated in the circuit board, and then the hot air is exhausted out of the electrical apparatus through the air outlet hole. In addition, the air outlet hole formed in the concave region could facilitate exhausting the hot air in order to enhance the heat-dissipating efficiency.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An electrical apparatus comprising:

a casing comprising a first entrance, a first receptacle communicating with said first entrance, a first sidewall, and a first bottom surface, wherein at least one air inlet hole is formed in said first bottom surface, a concave region is defined at a junction between a central portion of said first sidewall and said first bottom surface, and at least one air outlet hole is formed in a second surface of said concave region, at least one air outlet hole is formed in a lateral surface of said concave region, said second surface is adjacent to said lateral surface and an angle is defined between said second surface and said lateral surface of said concave region, and at least one air outlet hole is formed in the two sides adjacent to said concave region of said first sidewall, said at least one air outlet hole of said second surface of said concave region is at a distance from said first sidewall;

a control unit disposed on a first surface of said concave region, wherein said control unit is manipulated by a user to control operations of said electrical apparatus;

a circuit board disposed within said first receptacle and having at least one electronic component mounted thereon;

a top cover for sheltering said first entrance; and an active heat-dissipating element disposed within said first receptacle and arranged over said air inlet hole, wherein ambient air is inhaled into said first receptacle by said active heat-dissipating element and exhausted out of said casing through said air outlet holes of said second surface of said concave region, said lateral surface of said concave region and said first sidewall, thereby removing heat generated from said electronic component.

2. The electrical apparatus according to claim 1 wherein said electrical apparatus is an induction cooking stove.

3. The electrical apparatus according to claim 1 wherein said casing is an integral component.

4. The electrical apparatus according to claim 2 wherein said casing is made of iron.

5. The electrical apparatus according to claim 1 further comprising a supporting plate disposed over the circuit board for supporting an induction coil, wherein said induction coil is electrically connected with said circuit board for generating electromagnetic induction.

6. The electrical apparatus according to claim 5 wherein said supporting plate is made of aluminum.

7. The electrical apparatus according to claim 1 further comprising a receiving frame body disposed within said first receptacle for accommodating said circuit board, wherein said receiving frame body includes a second bottom surface and a side frame, and a portion of said side frame has a curvy surface defining an airflow guiding channel for guiding said air to flow in a specified direction.

8. The electrical apparatus according to claim 1 wherein said active heat-dissipating element is a fan.

9. The electrical apparatus according to claim 1 further comprising at least one heat sink mounted on said circuit board and disposed in the vicinity of said active heat-dissipating element for guiding said air to flow in a specified direction and facilitating removing heat of said electronic component.

10. An air circulating system comprising:

an electrical apparatus comprising:

a casing comprising a first entrance, a first receptacle communicating with said first entrance, a first sidewall, and a first bottom surface, wherein at least one air inlet hole is formed in said first bottom surface, a concave region is defined at a junction between a central portion of said first sidewall and said first bottom surface, and at least one air outlet hole is formed in a second surface of said concave region, at least one air outlet hole is formed in a lateral surface of said concave region, said second surface is adjacent to said lateral surface and an angle is defined between said second surface and said lateral surface of said concave region, and at least one air outlet hole is formed in the two sides adjacent to said concave region of said first sidewall, said at least one air outlet hole of said second surface of said concave region is at a distance from said first sidewall;

a control unit disposed on a first surface of said concave region, wherein said control unit is manipulated by a user to control operations of said electrical apparatus;

a circuit board disposed within said first receptacle and having at least one electronic component mounted thereon;

a top cover for sheltering said first entrance; and an active heat-dissipating element disposed within said first receptacle and arranged over said air inlet hole; and a cabinet having a third sidewall and a recess portion, wherein an outlet channel and a second entrance are formed in said third sidewall, said outlet channel communicates with said recess portion, and said electrical apparatus is accommodated within said recess portion of said cabinet, wherein ambient air inhaled by said active heat-dissipating element is introduced into said cabinet through said second entrance, then transferred through said first receptacle, then exhausted out of said electrical apparatus through said air outlet holes of said second surface of said concave region, said lateral surface of said concave region and said first sidewall, and finally exhausted out of said cabinet through said outlet channel, thereby removing heat generated from said electrical apparatus.

11. The air circulating system according to claim 10 wherein said electrical apparatus is an induction cooking stove.

12. The air circulating system according to claim 10 wherein said cabinet further includes a second receptacle that communicates with the surroundings through said second entrance.

13. The air circulating system according to claim 12 wherein a groove is defined between an outer wall of said second receptacle and an inner wall of said cabinet and communicates with said recess portion, and said second receptacle further comprises a third entrance communicating with said groove, wherein said ambient air inhaled by said active heat-dissipating element is introduced into said second receptacle through said second entrance, then introduced into said groove through said third entrance, then introduced into said casing through said air inlet hole, then transferred through an internal portion of said electrical apparatus, then exhausted out of said electrical apparatus through said air outlet hole of said second surface of said concave region, said lateral surface of said concave region and said first sidewall, and finally exhausted out of said cabinet through said outlet channel.

14. The air circulating system according to claim 10 wherein said casing is an integral component.

15. The air circulating system according to claim 10 wherein said electrical apparatus further includes a supporting plate disposed over the circuit board for supporting an induction coil, and said induction coil is electrically connected with said circuit board for generating electromagnetic induction.

16. The air circulating system according to claim 10 wherein said electrical apparatus further includes a receiving frame body disposed within said first receptacle for accommodating said circuit board, wherein said receiving frame body includes a second bottom surface and a side frame, and a portion of said side frame has a curvy surface defining an airflow guiding channel for guiding said air to flow in a specified direction.

17. The air circulating system according to claim 10 wherein said active heat-dissipating element is a fan.

18. The air circulating system according to claim 10 wherein said electrical apparatus further includes at least one heat sink mounted on said circuit board and disposed in the vicinity of said active heat-dissipating element for guiding said air to flow in a specified direction and facilitating removing heat of said electronic component.

* * * * *